US009394920B2

(12) United States Patent
Yamasaki et al.

(10) Patent No.: US 9,394,920 B2
(45) Date of Patent: Jul. 19, 2016

(54) CENTRIFUGAL FAN

(71) Applicant: MINEBEA CO., LTD., Kitasaku-Gun, Nagano (JP)

(72) Inventors: Takayuki Yamasaki, Fukuroi (JP); Seiya Fujimoto, Fukuroi (JP); Takako Otsuka, Fukuroi (JP); Masaki Ogushi, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 434 days.

(21) Appl. No.: 13/961,144

(22) Filed: Aug. 7, 2013

(65) Prior Publication Data

US 2014/0044534 A1 Feb. 13, 2014

(30) Foreign Application Priority Data

Aug. 10, 2012 (JP) ..... 2012-177775

(51) Int. Cl.

| | |
|---|---|
| ***F04D 29/30*** | (2006.01) |
| ***F04D 29/66*** | (2006.01) |
| ***F04D 29/28*** | (2006.01) |

(52) U.S. Cl.

CPC ..... *F04D 29/666* (2013.01); *F04D 29/281* (2013.01); *F04D 29/30* (2013.01)

(58) Field of Classification Search

CPC ..... F04D 29/281; F04D 29/30; F04D 29/666
See application file for complete search history.

(56) References Cited

U.S. PATENT DOCUMENTS

| | | | | |
|---|---|---|---|---|
| 2002/0150478 | A1 | 10/2002 | Aoki | |
| 2012/0045338 | A1 * | 2/2012 | Tadokoro | F04D 29/281 416/196 R |
| 2013/0004307 | A1 | 1/2013 | Fukuda et al. | |
| 2014/0010682 | A1 | 1/2014 | Suzuki et al. | |

FOREIGN PATENT DOCUMENTS

| | | | |
|---|---|---|---|
| JP | 63-289295 | A | 11/1988 |
| JP | 03-015604 | A | 1/1991 |
| JP | 2002-370517 | A | 12/2002 |
| JP | 2013-011239 | A | 1/2013 |
| JP | 2014-015849 | A | 1/2014 |

OTHER PUBLICATIONS

Japanese Office Action issued Apr. 30, 2014 in corresponding JP Patent Application 2012-177775.

* cited by examiner

*Primary Examiner* — Audrey K Bradley
(74) *Attorney, Agent, or Firm* — Carrier Blackman & Associates, P.C.; William D. Blackman; Jeffrey T. Gedeon

(57) ABSTRACT

A centrifugal fan includes a casing having an upper casing and a lower casing, and an impeller disposed between the upper and lower casing. The impeller includes an upper shroud having an upper portion formed with an inlet, a lower shroud, and a plurality of blades arranged along a circumference direction between the upper shroud and the lower shroud. The lower shroud is provided only on a portion at a side of a rotation axis of the impeller such that at least an outer circumferential side portion of each blade faces an upper surface of the lower casing. A surface of the lower casing, which faces the impeller, configures a portion of a wall surface which guides the fluid introduced from the inlet. Each blade has a shape which becomes thinner as increasing a distance from the upper shroud in a direction parallel to the rotation axis.

7 Claims, 16 Drawing Sheets

CENTRIFUGAL FAN

BACKGROUND OF THE INVENTION

1. Field of the Invention

The present invention relates to a centrifugal fan, and particularly, to a thin high-power centrifugal fan.

2. Description of the Related Art

FIG. 15 is a perspective view illustrating an example of a related-art centrifugal fan. FIG. 16 is a sectional side view illustrating the example of the related-art centrifugal fan.

As shown in FIGS. 15 and 16, a centrifugal fan 801 is generally configured by installing an impeller 830 in a casing 810 having an inlet 813 (833) and an outlet 819. The impeller 830 includes a plurality of blades 851 arranged around a rotating shaft of a motor 860. The centrifugal fan 801 suctions air from the inlet 813 (833), makes the air flow through the blades (wings) from the center of the impeller 830, and expels the air outward in the radial direction of the impeller 830 by a fluid force due to a centrifugal action according to rotation of the impeller 830. The air expelled outward from the outer circumference of the impeller 830 is discharged from the outlet 819 of the casing 810.

As shown in FIG. 16, the centrifugal fan 801 is thin. The centrifugal fan 801 has the motor 860 provided at the substantially center portion of the casing 810 in order for rotating the impeller 830. The motor 860 is an outer rotor type brushless motor disposed such that its rotor yoke 863 is fit in the impeller 830.

This centrifugal fan 801 is widely used for cooling, ventilation, and air-conditioning of appliances, office automation equipment, and industrial equipment, blowers for vehicles, etc. The blowing performance and noise of the centrifugal fan 801 are greatly affected by the wing (blade) shape of the impeller 830 and the shape of the casing 810 (the structure of the centrifugal fan 801).

In order to reduce noise or to improve blowing performance, it has been performed to optimize the shapes of impellers or the structures of casings, and various proposals have been made.

For example, JP-A-S63-289295 discloses a centrifugal fan in which a shape of a blade (wing) is optimized to reduce noise.

With the progress of size reduction, thickness reduction, high-density mounting, and energy-saving of various apparatuses, it has been always required to improve the efficiency and static pressure of a centrifugal fan to be mounted on those apparatuses. At the same time, it has been always required to further reduce the level of noise generated by driving of a centrifugal fan.

SUMMARY OF THE INVENTION

The present invention has been made in view of the above circumstances, and an object of the present invention is to provide a centrifugal fan which is thin and highly efficient and is capable of reducing generation of noise.

According to an illustrative embodiment of the present invention, there is provided a centrifugal fan comprising: a casing having an upper casing and a lower casing, and an impeller disposed between the upper casing and the lower casing. The impeller includes an upper shroud having an upper portion formed with an inlet, a lower shroud, and a plurality of blades arranged along a circumference direction between the upper shroud and the lower shroud. A fluid introduced from the inlet is discharged to a side of the impeller according to rotation of the impeller. The lower shroud is provided only on a portion at a side of a rotation axis of the impeller such that at least an outer circumferential side portion of each blade faces an upper surface of the lower casing. A surface of the lower casing, which faces the impeller, configures a portion of a wall surface which guides the fluid introduced from the inlet. Each blade has a shape which becomes thinner as increasing a distance from the upper shroud in a direction parallel to the rotation axis of the impeller.

In the above centrifugal fan, each blade may have a tapered shape such that a pressure surface thereof approaches a negative pressure surface thereof as increasing the distance from the upper shroud in the direction parallel to the rotation axis of the impeller.

In the above centrifugal fan, the pressure surface of each blade may have the tapered shape having an angle with respect to the rotation axis of the impeller being 4° or more and 16° or less.

In the above centrifugal fan, the pressure surfaces of each blade may have the tapered shape having an angle with respect to the rotation axis of the impeller being 4° or more and 8° or less.

In the above centrifugal fan, a negative pressure surface of each blade may be a surface perpendicular to a horizontal plane perpendicular to the rotation axis of the impeller.

In the above centrifugal fan, each blade may have a trapezoidal shape in a cross section on a plane which is perpendicular to a horizontal plane perpendicular to the rotation axis of the impeller and is perpendicular to a pressure surface thereof as seen in a bottom view.

In the above centrifugal fan, as seen from a direction in which the rotation axis of the impeller extends, a pressure surface of each blade may have a shape in which at least three arcs are connected, or a shape expressed by a combination of a plurality of high-dimensional functions passing three points.

The above centrifugal fan may further comprise a motor which is attached to the lower shroud and configured to rotate the impeller to introduce the fluid from the inlet and discharge the fluid to the side of the impeller.

According to the above configuration, each blade has a shape which becomes thinner as increasing a distance from the upper shroud in a direction parallel to the rotation axis of the impeller. Therefore, a centrifugal fan which is thin and highly efficient and is capable of reducing generation of noise can be provided.

DETAILED DESCRIPTION

Hereinafter, a centrifugal fan according to an illustrative embodiment of the present invention will be described.

Figure 1:
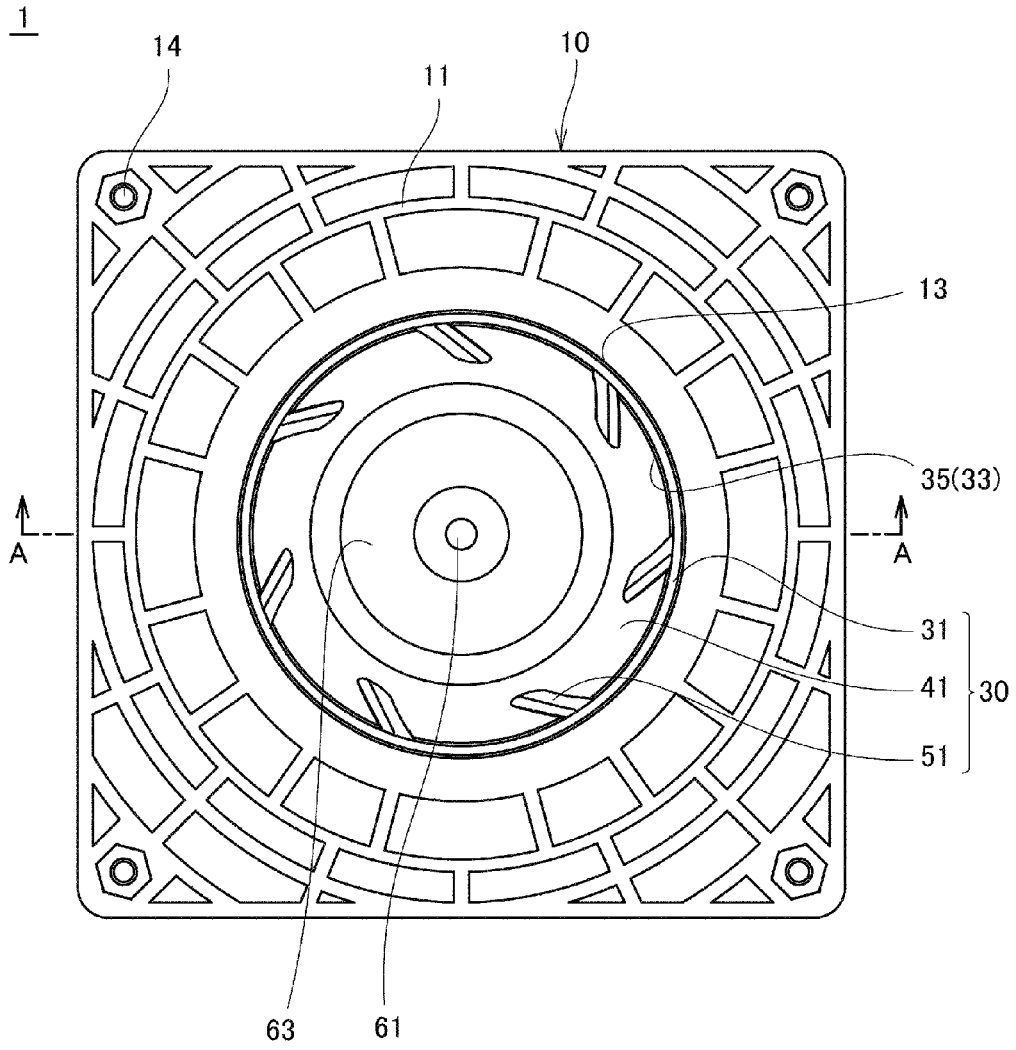
FIG. 1 is a plan view illustrating a centrifugal fan according to an illustrative embodiment of the present invention.
Figure 2:
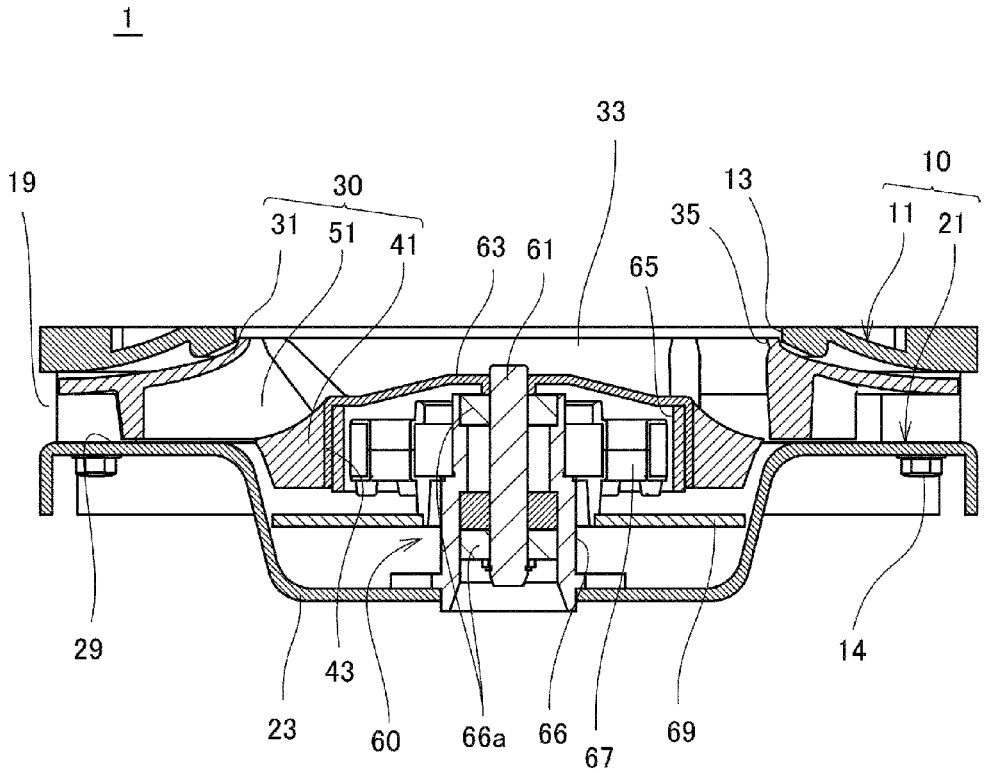
FIG. 2 is a cross-sectional view taken along the line A-A of FIG. 1.
Figure 3:
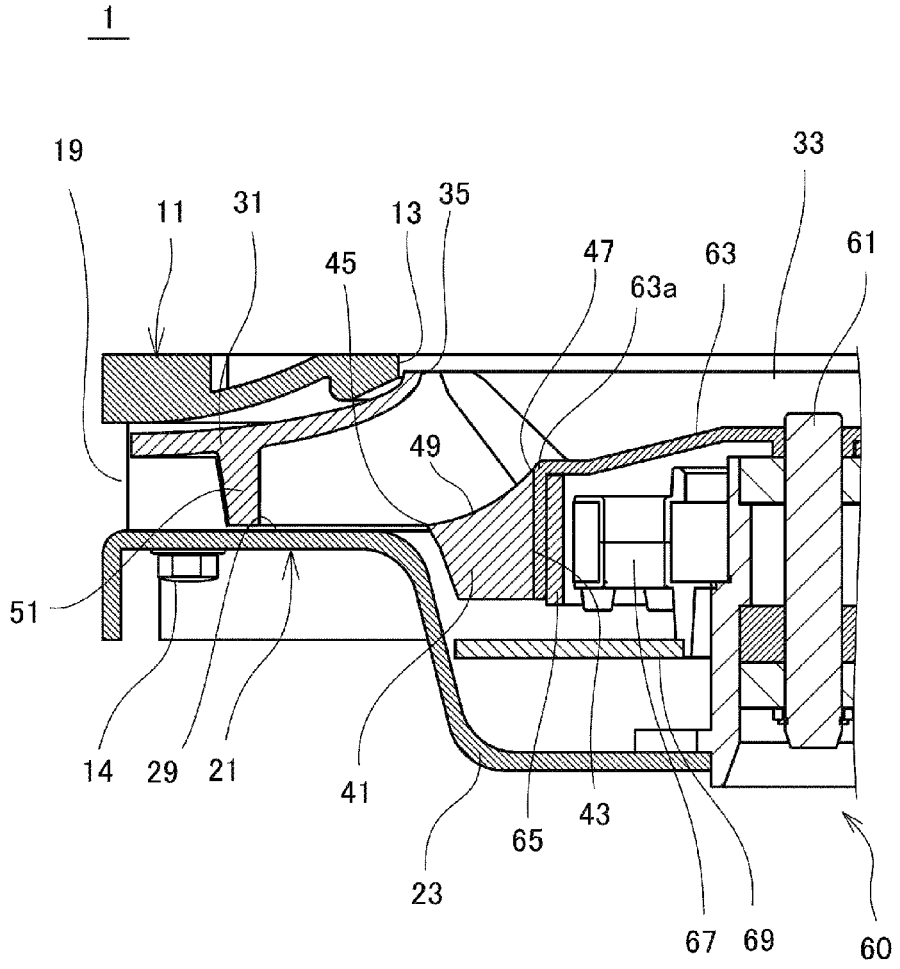
FIG. 3 is a partial enlarged view of FIG. 2.

FIG. 1 is a plan view illustrating a centrifugal fan according to an illustrative embodiment of the present invention. FIG. 2 is a cross-sectional view taken along the line A-A of FIG. 1. FIG. 3 is a partial enlarged view of FIG. 2.

Referring to FIGS. 1 to 3, a centrifugal fan 1 includes a casing 10, an impeller 30, and a motor 60. Except for a portion where the motor 60 is fit, the centrifugal fan 1 is generally configured in a cuboid shape which is substantially square as seen in a plan view. The centrifugal fan 1 is a thin fan whose dimension in a vertical direction (height) is comparatively small. The impeller 30 is mounted on a rotor 63 which rotates together with a shaft 61 of the motor 60. The centrifugal fan 1 rotates the impeller 30 by the motor 60. The centrifugal fan 1 discharges an air (an example of a fluid) introduced from an inlet 33 to the side of the impeller 30 by rotation of the impeller 30. That is, the air introduced from the inlet 33 passes through a plurality of blades 51 of the impeller 30 and is expelled outward in the radial direction of the impeller 30 by a fluid force due to a centrifugal action according to the rotation of the impeller 30. The air is discharged from outlets 19 of the casing 10 which are at the side of the impeller 30.

The motor 60 is, for example, an outer rotor type brushless motor. The motor 60 is mounted at the center portion of a lower casing 21 by fastening members such as screws, bolts, and the like. The motor 60 has the rotor (rotor yoke) 63 having a cup-shape, and the rotor 63 is open toward a lower side. On an inner surface of a side peripheral portion of the rotor 63, an annular magnet 65 is mounted. The shaft 61 is fit into the center portion of the rotor 63.

The shaft 61 is rotatably supported by a pair of bearings 66*a* fit in a bearing holder 66. On an outer circumferential portion of the bearing holder 66, a stator 67 is mounted. The stator 67 includes stacked stator cores, an insulator formed by winding a coil and mounted on the state cores, and so on. The stator 67 is disposed to face the magnet 65 with a predetermined gap in a radial direction (in a left-right direction in FIG. 2). The stator 67 is connected to a circuit board 69. The circuit board 69 is, for example, a printed circuit board. On the circuit board 69, various components such as an electronic component for controlling the motor 60 is mounted, and a drive circuit for the motor 60 is mounted.

The casing 10 is configured by assembling an upper casing 11 and the lower casing 21. Specifically, the upper casing 11 and the lower casing 21 are assembled with each other by fastening screws 14 which are positioned at four corners as seen in a plan view, whereby the casing 10 is configured. The screws 14 are, for example, bolts which are fit from a side of the lower casing 21. The upper casing 11 and the lower casing 21 are assembled with each other, for example, with supports interposed therebetween at the portions where the screws 14 are arranged. In this case, the supports may be configured integrally with either one of the upper casing 11 and the lower casing 21. The outlets 19 may be formed between the upper casing 11 and the lower casing 21, for example, at side portions of the casing 10 except for the fastening portions of the upper casing 11 and the lower casing 21 using the screws 14.

The impeller 30 is disposed to be accommodated in the casing 10. Above the impeller 30, the upper casing 11 is disposed, and below the impeller 30, the lower casing 21 is disposed. That is, the centrifugal fan 1 is configured by holding the impeller 30 between the upper casing 11 and the lower casing 21.

The impeller 30 includes an upper shroud 31, a lower shroud 41, and the plurality of blades 51 disposed between the upper shroud 31 and the lower shroud 41. At the center portion of the impeller 30, the inlet 33 is formed to be open toward the upper side. The inlet 33 is formed to be surrounded by an upper end portion 35 of the upper shroud 31 on the inner side. The plurality of blades 51 are arranged at appropriate intervals on a circumference direction.

At the center portion of the impeller 30, there is disposed the lower shroud 41 into which the rotor 63 is fit. At the center portion of the lower shroud 41, a cylindrical portion 43 is formed to allow the rotor 63 to be disposed therein. The rotor 63 is fit into the cylindrical portion 43 formed at the center portion of the lower shroud 41, thereby holding the impeller 30. The rotor 63 is disposed inside the inlet 33 to protrude upward toward the outside of the inlet 33.

Each of the blades 51 has the same curved shape. The specific shapes of the blades 51 will be described below. The upper shroud 31, the lower shroud 41, and the blades 51 may be formed by integral molding using, for example, synthetic resins.

The upper casing 11 is made of, for example, a resin such as engineering plastic. At the center portion of the upper casing 11, an opening 13 is formed. The opening 13 is circular as seen in a plan view. The opening 13 is formed such that air is introduced into the inlet 33 of the impeller 30. The opening 13 has an inside diameter slightly larger than that of the inlet 33 formed in the upper shroud 31. That is, in the present illustrative embodiment, the size of the opening 13 is substantially the same as the size of the inlet 33.

The lower casing 21 is made of, for example, a plate of a metal such as iron. At the center portion of the lower casing 21, a recess 23 is formed downward. The recess 23 is formed in a bowl shape. As shown in FIG. 2, in the present illustrative embodiment, in the recess 23, the motor 60, and the drive circuit for the motor 60 such as the circuit board 69 are installed. The motor 60 is mounted on the lower casing 21 by fastening members such as screws and bolts; however, the motor 60 may be mounted on the lower casing 21 by fixing the lower portion of the bearing holder 66 into the recess 23, instead of using the fastening members.

The outer circumferential portion of the lower casing 21 has a side plate bent in an axial direction (in an upper-lower direction of FIG. 2). The rigidity of the lower casing 21 can be improved by providing the side plate.

In the upper surface of the lower casing 21, a portion around the recess 23 is a partition portion 29 facing the lower surface of the impeller 30. The partition portion 29 is formed in a flat plate shape to be close to the lower surface of the impeller 30.

As shown in FIG. 2, the lower shroud 41 of the impeller 30 is provided only on a portion of the blades 51 at a side of the shaft (the rotation axis of the impeller 30) 61 such that at least an outer circumferential side portion of each blade 51 faces the partition portion 29. That is, the blades 51 are exposed at a portion of the impeller 30 facing the partition portion 29. A surface of the lower casing 21, which faces the impeller 30, configures a portion of a wall surface which guides air introduced from the inlet 33 to the side. The blades 51 are disposed to face the partition portion 29 with a predetermined gap in an axial direction. Incidentally, the lower portion of each blade 51 may be partially or wholly exposed to the partition portion 29.

The dimension of the outside diameter of the impeller 30 which is accommodated in the casing 10 is set to be smaller than the dimension of one side of the casing 10. Therefore, the impeller 30 does not protrude from the outer edge of the casing 10 when rotating, and thus contact of the impeller 30 with other members, damages due to contact, and the like can be reduced or prevented.

The lower casing 21 serves not only as a main plate for guiding air in the impeller 30, but also the substrate of the casing 10. For this reason, setting of the gap which is formed between the impeller 30 and the partition portion 29 may be important. In a case where the gap is excessively large, air suctioned from the inlet 33 flows even into the gap while passing through the blades 51. As a result, the pressure of air expelled from the impeller is reduced, and thus a blowing characteristic is reduced. Meanwhile, in a case where the gap is excessively small, there is the following problem. That is, if a variation occurs in the accuracy of the dimensions of each component, there is a possibility that the blades 51 will come into contact with the partition portion 29. In order to prevent this contact, it is necessary to manage the accuracy of the dimensions of each component with a high degree of accuracy, and thus the manufacturing cost of the centrifugal fan 1 increases. In view of those problems, the gap between the impeller 30 and the partition portion 29 is appropriately set.

Subsequently, the structure of the impeller 30 will be described in more detail.

Figure 4:
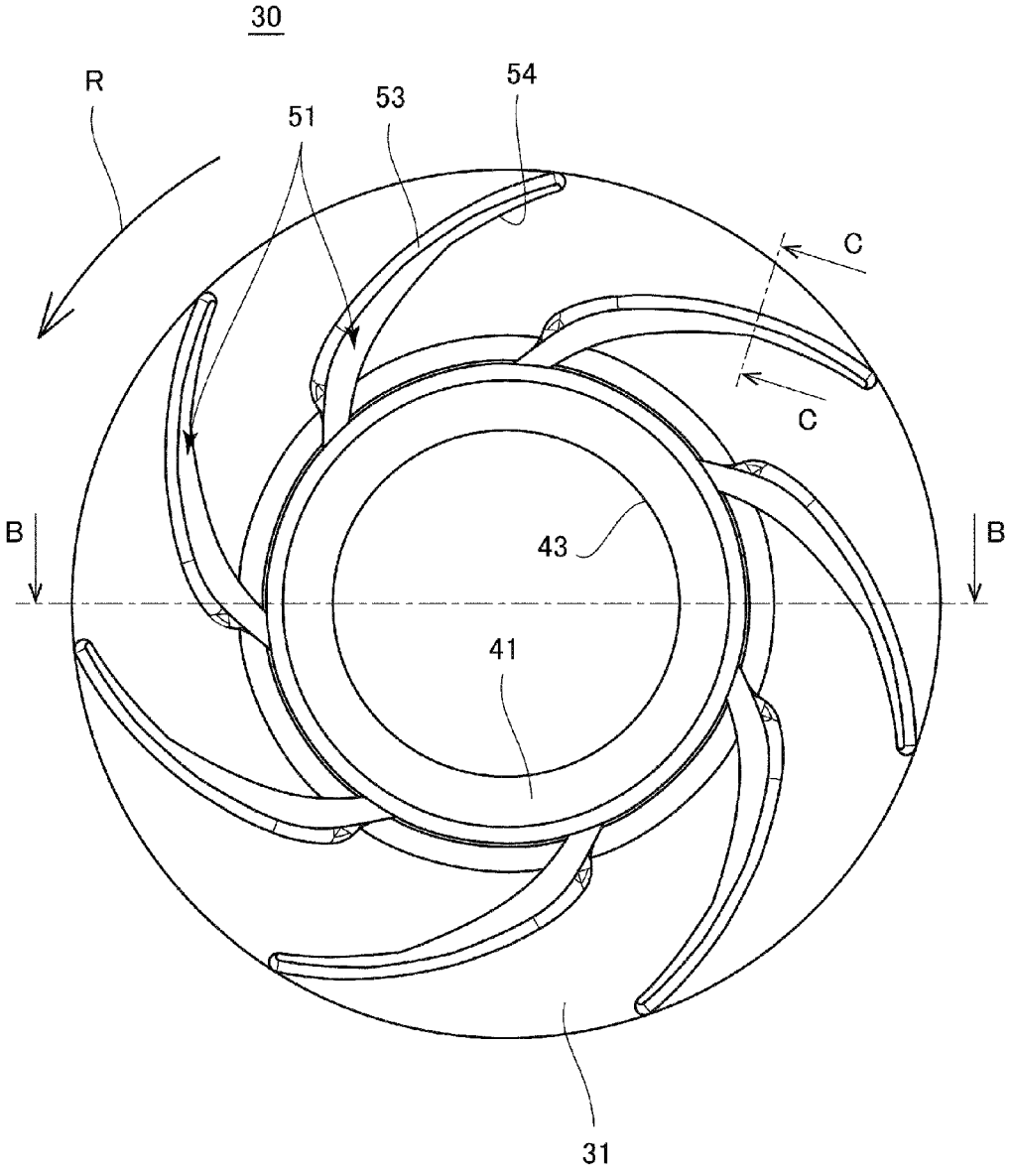
FIG. 4 is a bottom view of an impeller.
Figure 5:
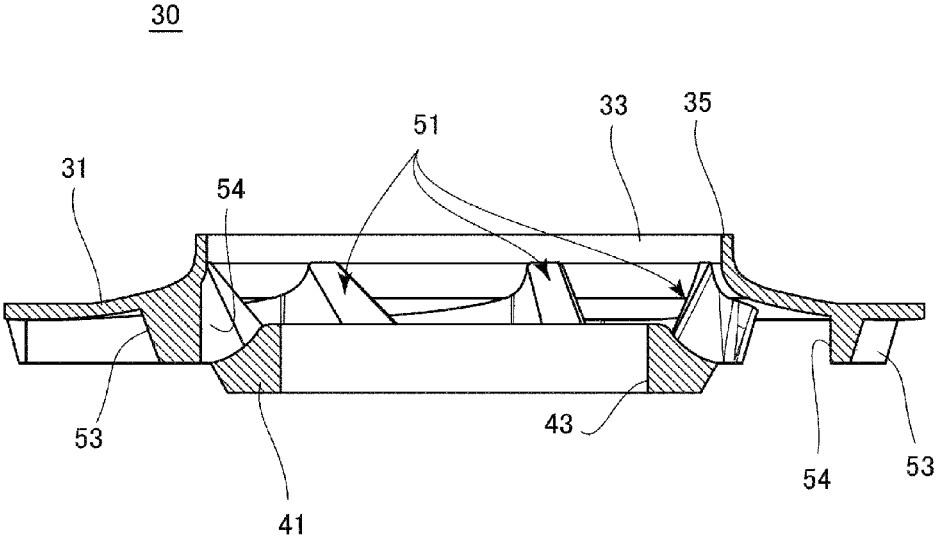
FIG. 5 is a cross-sectional view taken along the line B-B of FIG. 4.

FIG. 4 is a bottom view of the impeller 30. FIG. 5 is a cross-sectional view taken along the line B-B of FIG. 4.

As shown in FIGS. 4 and 5, in the impeller 30, for example, seven blades 51 are arranged. Each blade 51 has a pressure surface 53 and a negative pressure surface 54. The pressure surface 53 is directed to a leading side of the impeller 30 in the rotation direction. The negative pressure surface 54 is directed to the opposite side to the pressure surface 53.

The blades 51 are backward inclined blades, and are of a so-called turbo type. The blades 51 have a blade shape inclined backward with respect to the rotation direction (a counterclockwise direction, that is, a direction shown by an arrow R in FIG. 4). The specific shape of each blade 51 is, for example, as follows. That is, as shown in FIG. 4 to be described below, as the pressure surface 53 is seen from a direction in which the rotation axis of the impeller 30 extends, the pressure surface 53 has roughly a shape in which three arcs are connected. These arcs are connected such that neighboring arcs are tangent to each other.

In the present illustrative embodiment, the inlet angle, outlet angle, and camber angle of each blade 51 are set to about 45°, about 30°, and about 55°, respectively. However, the inlet angle, outlet angle, and camber angle of each blade 51 are not limited to those values. Herein, the term "inlet angle" refers to an angle which is formed by a tangent line of an inner circumferential edge (a circle having the rotation axis of the impeller 30 as its center and having a circumference on which an inner side edge of the blade 51 as seen in a bottom view) and a tangent line of a curved line indicating the pressure surface 53 and shown in FIG. 7 at a point where the inner circumferential edge and the curved line indicating the pressure surface 53 are in contact with each other, and is 90° or less. The term "outlet angle" refers to an angle which is formed by a tangent line of an outer circumferential edge (a circle having the rotation axis of the impeller 30 as its center and having a circumference on which an outer side edge of the blade 51 as seen in a bottom view) and a tangent line of the curved line indicating the pressure surface 53 at a point where the outer circumferential edge and the curved line indicating the pressure surface 53 are in contact with each other, and is 90° or less. The term "camber angle" is an angle which is formed by a line connecting the inner side edge of a blade 51 and the rotation axis of the impeller 30, and a line connecting the outer side edge of the corresponding blade 51 and the rotation axis as seen in a bottom view.

Figure 6:
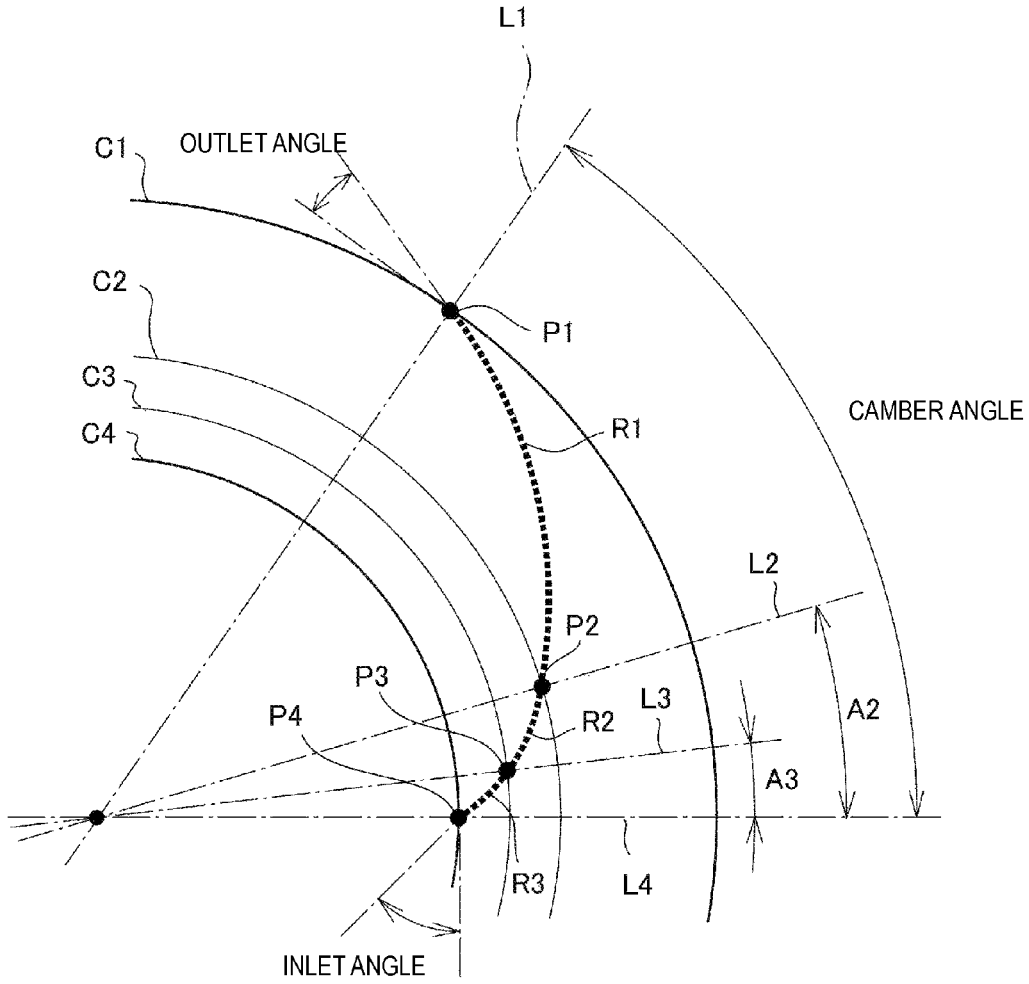
FIG. 6 is a view illustrating a shape of a pressure surface of a blade.

FIG. 6 is a view illustrating a shape of a pressure surface 53 of a blade 51.

The shape of each pressure surface 53 is determined, for example, as follows. That is, the sizes of the inner circumferential edge and the outer circumferential edge are determined according to design specifications, the size of the motor, and so on. In view of the design specifications and reducing the level of noise such as NZ sound, the inlet angle, the outlet angle, and the camber angle are determined. Therefore, as seen in the bottom view, first to fourth points which the pressure surface 53 passes are determined. That is, as shown in FIG. 6, a first point P1 becomes the vertex of the outlet angle. A fourth point P4 becomes the vertex of the inlet angle. A second point P2 is the intersection of a first circle C2 which is concentric with a circle C1 indicating the outer circumferential edge and has a size of ¾ of the size of the circle C1, and a straight line L2 that forms an angle A2 of 3/10 of the camber angle with respect to a straight line L4 extending from the rotation axis to the fourth point P4. A third point P3 is the intersection of a second circle C3 that is concentric with the first circle C2 and is positioned between the first circle C2 and a circle C4 indicating the inner circumferential edge, and the straight line L4 that forms an angle A3 of 3/20 of the camber angle with respect to the straight line L4. Further, the first point P1 and the second point P2, the second point P2 and the third point P3, and the third point P3 and the fourth point P4 are connected by arcs R1, R2, and R3, respectively. In this case, the three arcs R1, R2, and R3 are drawn such that the inlet angle and the outlet angle become predetermined angles, two arcs R1 and R2 connected to each other have a tangent relation (a relation in which the tangent lines of the two arcs at the contact point of the two arcs overlap each other), and two arcs R2 and R3 connected to each other have a tangent relation. In this way, the shape of each pressure surface 53 is determined.

The negative pressure surface 54 has roughly a curved shape following the pressure surface 53 as seen in a bottom view such that a distance from the pressure surface 53 is reduced as increasing a distance from the rotation axis of the impeller 30. Therefore, each blade 51 has a wing-like outer shape.

As the pressure surface 53 is seen from the direction in which the rotation axis of the impeller 30 extends, the pressure surface 53 may have a shape expressed by combining a plurality of high-dimensional functions passing three points.

That is, in the present illustrative embodiment, the shape of the pressure surface 53 of each blade 51 is formed by three arcs as seen in the bottom view. Therefore, the flow and static pressure of the centrifugal fan can be improved and noise of the centrifugal fan can be reduced.

In the present illustrative embodiment, the thickness of each blade 51, that is, the distance between the pressure surface 53 and negative pressure surface 54 of each blade 51 is reduced as increasing a distance from the upper shroud 31 in a direction parallel to the rotation axis. In other words, each blade 51 is formed to become thinner as it approaches the partition portion 29. Therefore, the distance between the pressure surface 53 of a blade 51 and the negative pressure surface 54 of another blade 51 next to the corresponding blade 51 increases as they approach the partition portion 29.

Figure 7:
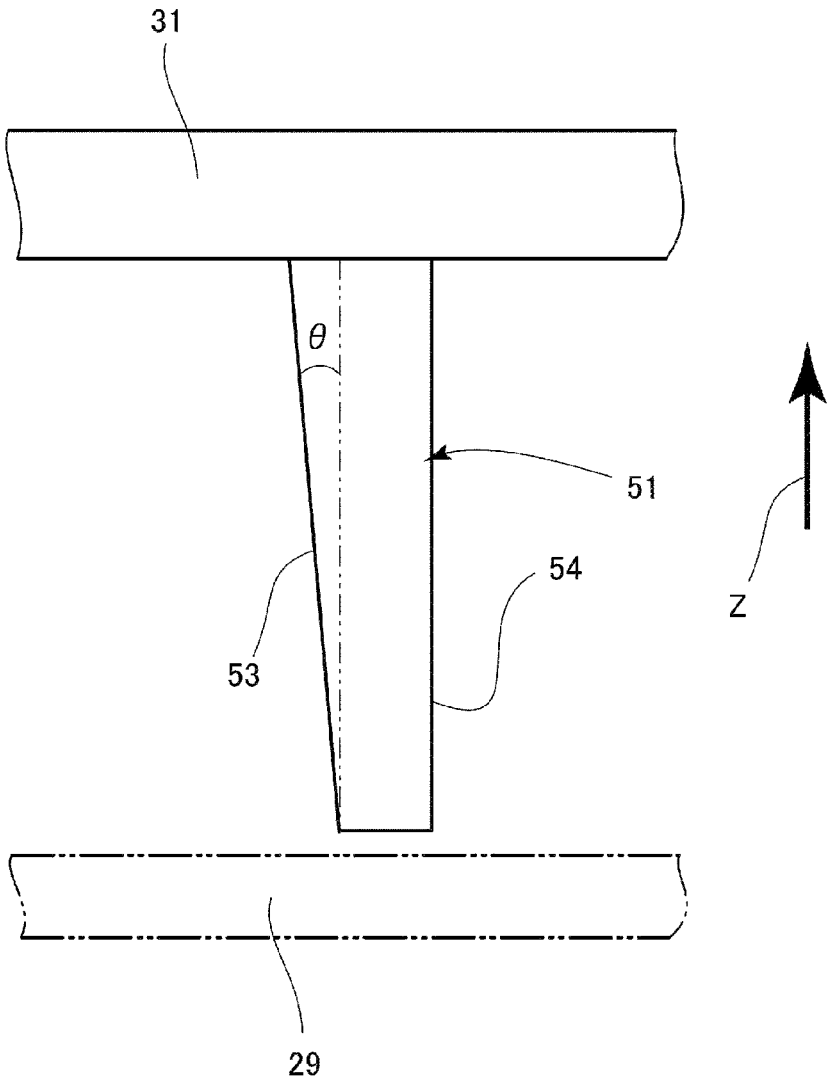
FIG. 7 is a view schematically illustrating a cross section of the blade.
Figure 8:
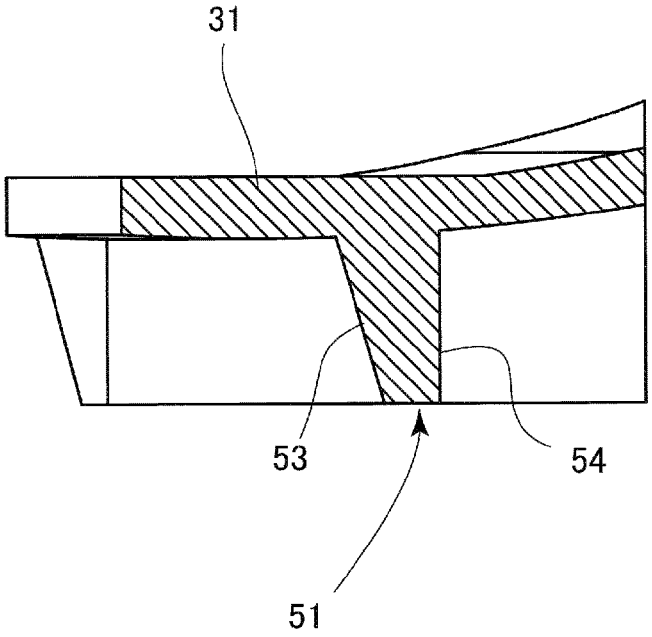
FIG. 8 is a cross-sectional view taken along the line C-C of FIG. 4.
Figure 9:
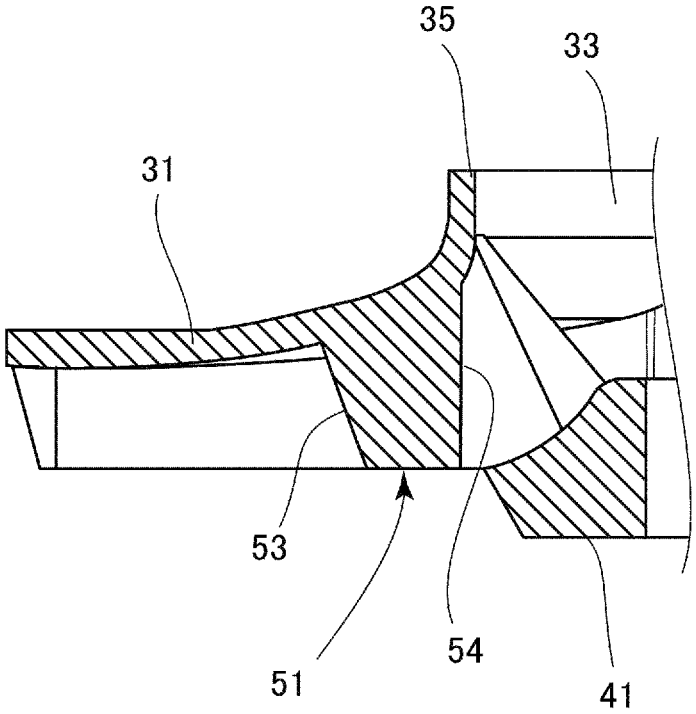
FIG. 9 is a partial enlarged view of FIG. 5.

FIG. 7 is a view schematically illustrating a cross section of the blade 51. FIG. 8 is a cross-sectional view taken along the line C-C of FIG. 4. FIG. 9 is a partial enlarged view of FIG. 5.

The cross section shown in FIG. 7 is a cross section which is perpendicular to a horizontal plane perpendicular to the rotation axis and is substantially perpendicular to the pressure surface 53 as seen in a bottom view. In FIG. 7, hatching is omitted. An arrow Z indicates a direction (upper side) parallel to the rotation axis of the impeller 30. FIG. 8 shows the cross section (C-C cross section) same as FIG. 7.

The pressure surface 53 is away from the negative pressure surface 54 in a direction of approaching the outer circumferential side of the blade 51 (the left side in FIG. 7) as it approaches the upper shroud 31. In other words, each blade 51 has a tapered pressure surface 53. In the present illustrative embodiment, over the entire area of every blade 51 from the inner side to the outer side, a pressure surface 53 is formed in that tapered shape.

In FIG. 7, an angle θ represents the inclination, that is, a taper angle of a pressure surface 53 with respect to the rotation axis of the impeller 30. In each blade 51, the negative pressure surface 54 is substantially parallel to the rotation axis in a cross section as shown in FIG. 7. That is, each negative pressure surface 54 is formed to become a plane perpendicular to a horizontal plane perpendicular to the rotation axis of the impeller 30.

The lower end portion of each blade 51 is substantially horizontal (parallel to a plane perpendicular to the arrow Z of FIG. 7) in the cross section shown in FIG. 7. Therefore, each blade 51 has a trapezoidal shape in a cross section as shown in FIGS. 7 and 8.

In the present illustrative embodiment, the taper angle θ of the pressure surface 53 of the blade 51 is set to, for example, about 4° to 8°. Therefore, the noise level can be reduced while securing a high static pressure, as compared to a case where the taper angle of every pressure surface 53 is 0° (that is, there is no taper angle).

Figure 10:
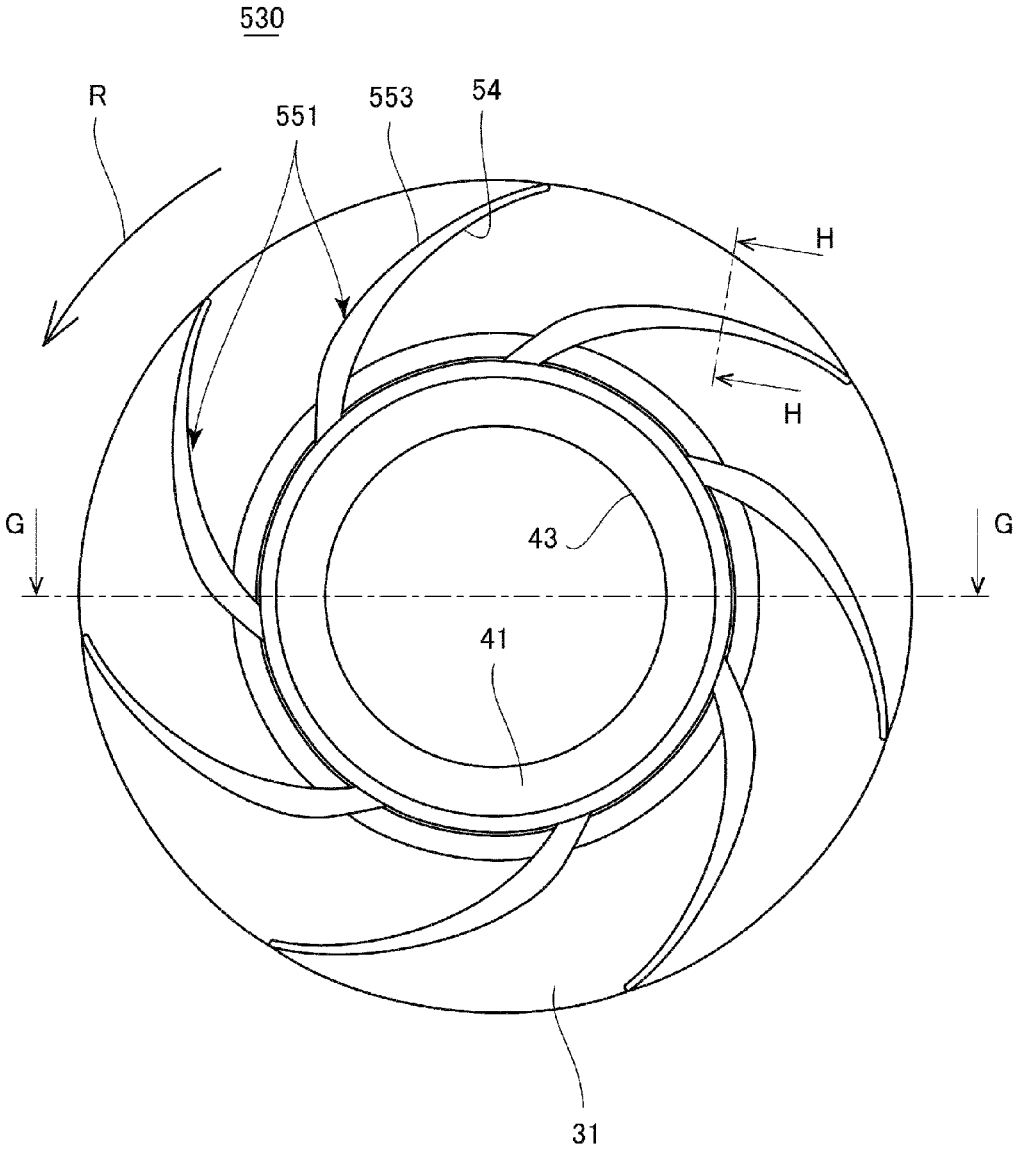
FIG. 10 is a bottom view of an impeller according to a comparative example.
Figure 11:
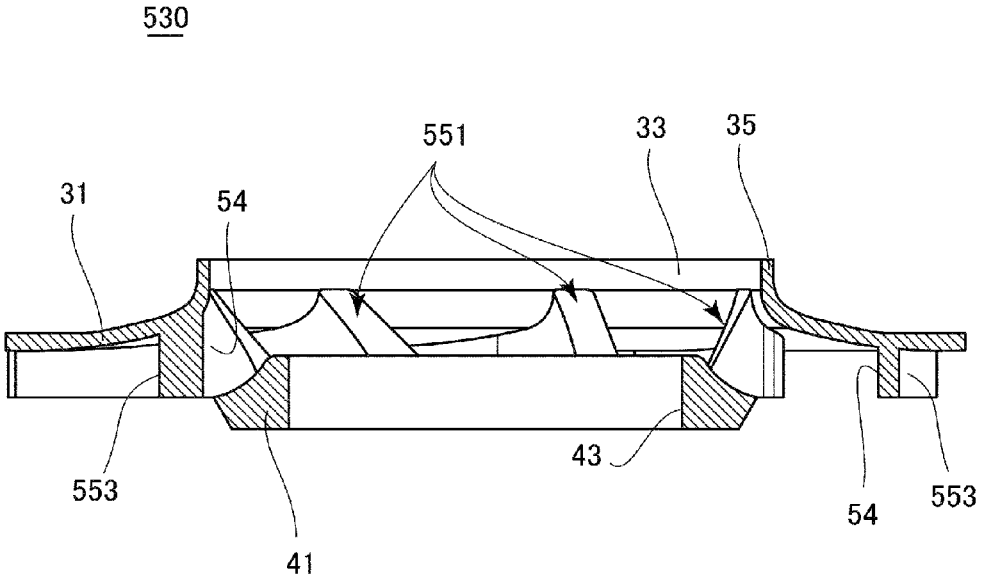
FIG. 11 is a cross-sectional view taken along the line G-G of FIG. 10.
Figure 12:
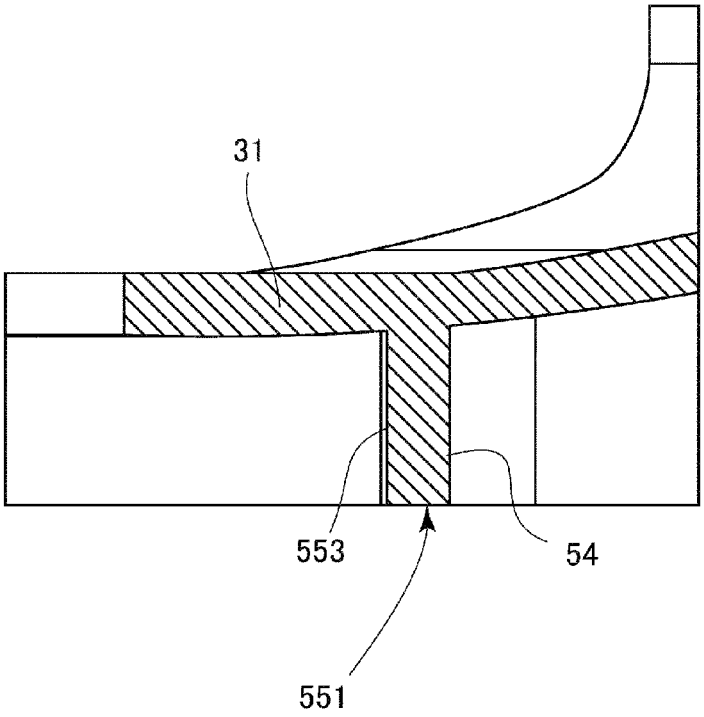
FIG. 12 is a cross-sectional view taken along the line H-H of FIG. 10.

FIG. 10 is a bottom view illustrating an impeller 530 according to a comparative example with respect to the present illustrative embodiment. FIG. 11 is a cross-sectional view taken along the line G-G of FIG. 10. FIG. 12 is a cross-sectional view taken along the line H-H of FIG. 10.

Each of FIGS. 10 to 12 shows the impeller 530 according to the comparative example with respect to the present illustrative embodiment. That is, the impeller 530 is different from the impeller 30 in that the impeller 530 has blades 551 in which the taper angle of each pressure surface 53 is 0°. The shapes and structures of the other portions of the impeller 530 are the same as those of the impeller 30. That is, in the impeller 530, each blade 551 is configured such that both of a pressure surface 53 and a negative pressure surface 54 become curved surfaces which are substantially vertical.

Figure 13:
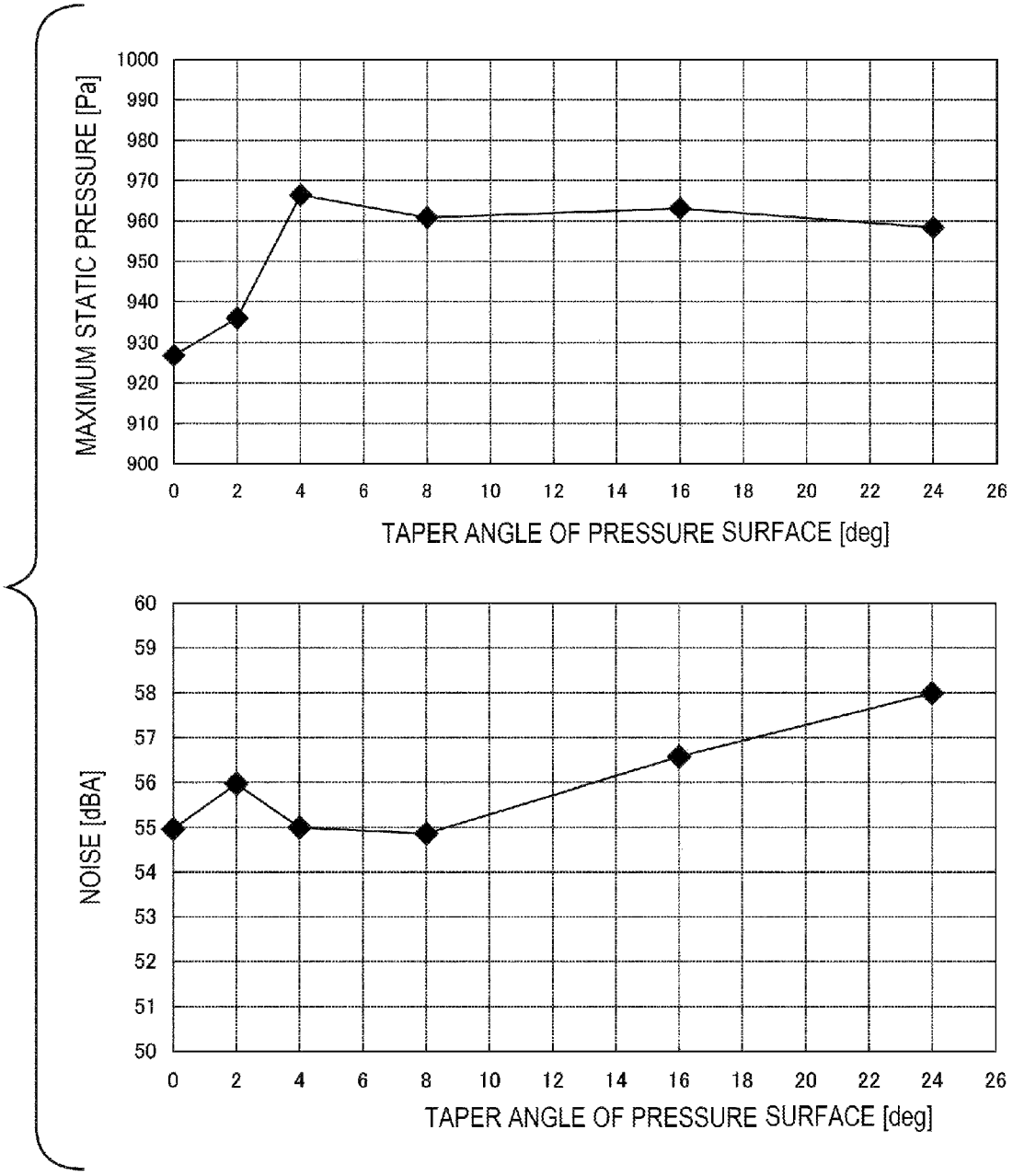
FIG. 13 is a first graph illustrating a relation between a magnitude of a maximum static pressure and a level of noise.
Figure 14:
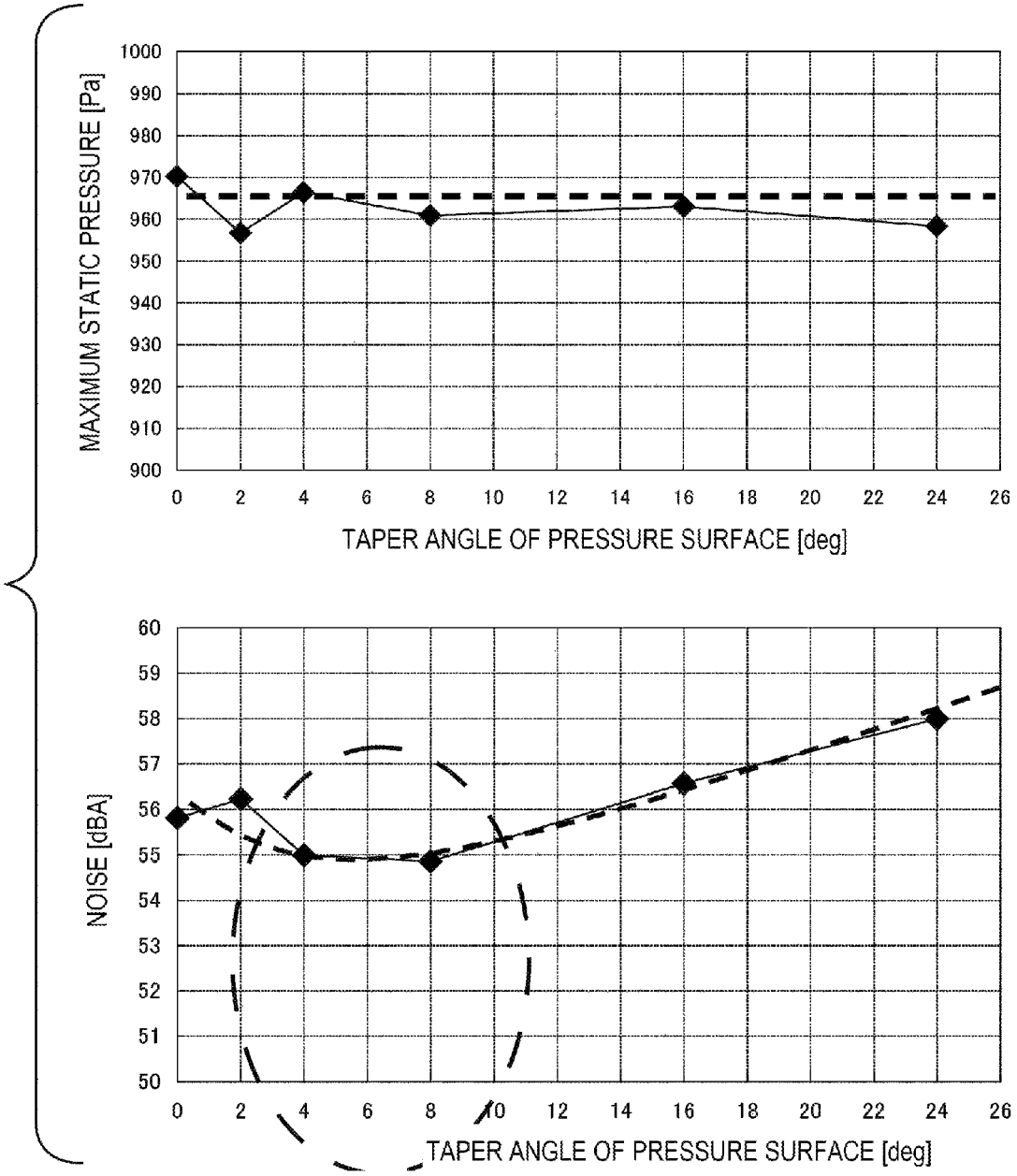
FIG. 14 is a second graph illustrating a relation between a magnitude of a maximum static pressure and a level of noise.
Figure 15:
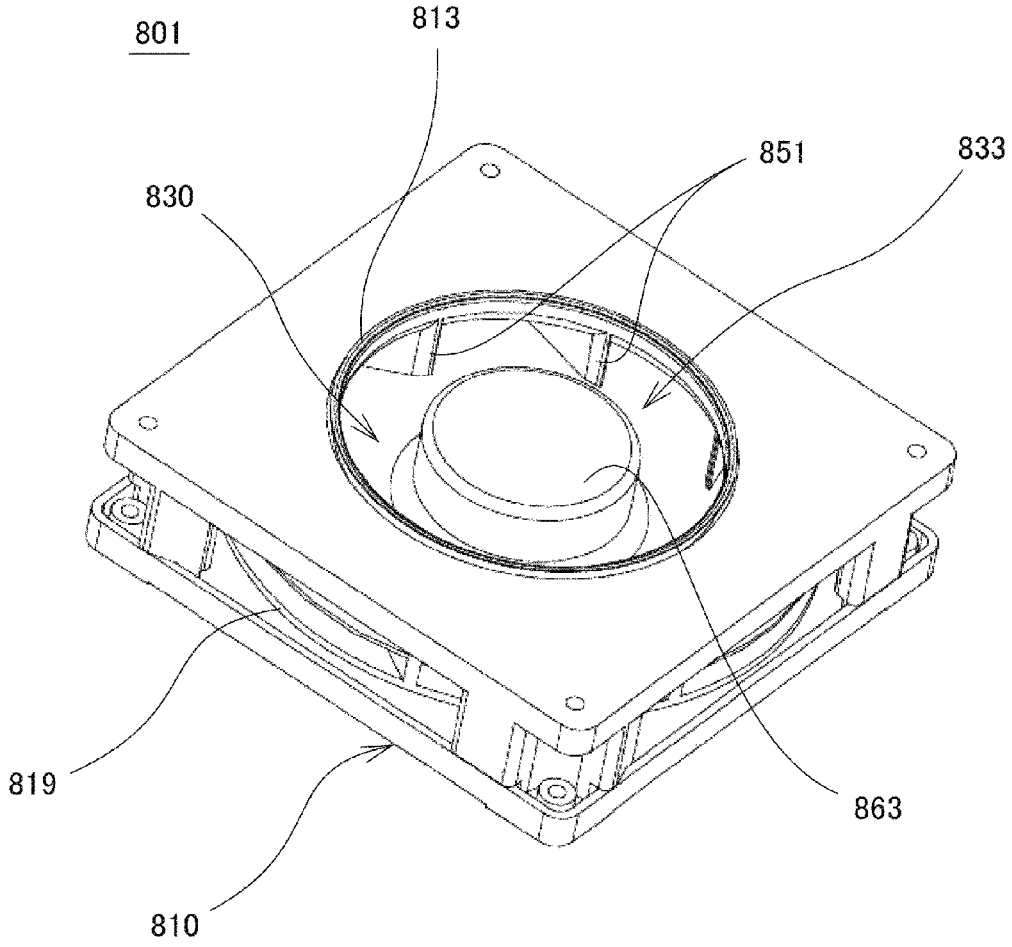
FIG.15 RELATED ART
FIG. 15 is a perspective view illustrating an example of a related-art centrifugal fan.
Figure 16:
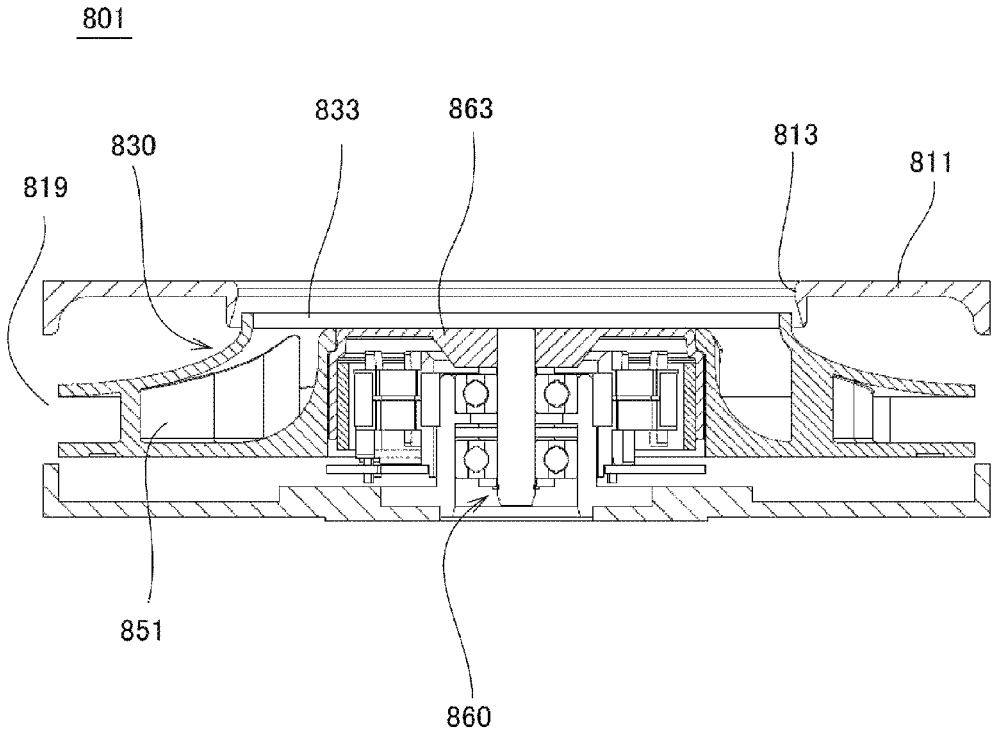
FIG.16 RELATED ART
FIG. 16 is a sectional side view illustrating the example of the related-art centrifugal fan.

FIG. 13 is a first graph illustrating the relation between the magnitude of the maximum static pressure and the level of noise. FIG. 14 is a second graph illustrating the relation between the magnitude of the maximum static pressure and the level of noise.

The graphs of FIGS. 13 and 14 show the results obtained by measuring the magnitude of the maximum static pressure and the level of noise while changing the taper angle of the pressure surface 53 of every blade 51 from 0° (which is a taper angle in the comparative example) to 2°, 4°, 8°, 16°, 24°, etc., in a centrifugal fan 1 having the following specifications. The graphs are based on data. In this case, the height H of each blade 51 at the side of the inlet 33 of the centrifugal fan 1 is 13.5 mm. Also, the height h of each blade 51 at the side of the outlet 19 is 6 mm.

FIG. 13 shows the magnitude of the maximum static pressure (the upper graph of FIG. 13) and the level of noise (the lower graph of FIG. 13) according to a change in the taper angle of every pressure surface 53 after controlling the number of revolutions (duty ratio) of the motor 60 to be substantially constant.

As shown in FIG. 13, the magnitude of the maximum static pressure is larger when the taper angle is 4° or more, as compared to the comparative example (in which the taper angle is 0°). In a range in which the taper angle is 4° or more, the maximum static pressure is substantially constant. In contrast to this, the level of noise is the same as or lower than that in the comparative example in a range in which the taper angle is 4° or more and 8° or less, but gradually rises if the taper angle becomes larger than 8°. It can be said that when the taper angle is about 16°, the noise is not much larger than that in the comparative example; however, if the taper angle becomes 24°, the noise is considerably larger than that in the comparative example.

FIG. 14 shows the level of noise according to a change in the taper angle of every pressure surface 53 in a case where the number of revolutions of the impeller 30 is adjusted such that the maximum static pressure became constant. The value of the level of noise is a measured value. That is, the upper graph shows a case where the maximum static pressure is controlled to be about 960 Pa to 970 Pa with respect to each taper angle. Further, the lower graph shows the level of noise generated in the centrifugal fan 1 in that case.

Referring to the lower graph of FIG. 14, in the present illustrative embodiment, when the taper angle of every pressure surface 53 is 16° or less, the noise value is the same as or smaller than that in the comparative example. Especially, as shown in a broken line circle in FIG. 14, when the taper angle is 4° or more and 8° or less, the magnitude of the noise value is considerably smaller than that in the comparative example.

Accordingly, in the present illustrative embodiment, the taper angle is set for the pressure surfaces 53 of the blades 51 such that each pressure surface 53 becomes a tapered shape. As can be seen from data shown in FIGS. 13 and 14, if the pressure surfaces 53 are formed in a tapered shape, the maximum static pressure can be increased and generation of noise can be suppressed in the centrifugal fan 1 using the impeller 30. Therefore, the centrifugal fan 1 can be made thin, highly-efficient, and low-noise. In this case, if the taper angle is set to about 4° or more and 16° or less, the above described effects can be efficiently obtained. If the taper angle is preferably set to 4° or more and 8° or less, an effect of reducing noise can be further efficiently obtained, and the maximum static pressure can be increased without worsening the noise value.

In each blade 51, the pressure surface 53 is configured by combination of three or more arcs as seen in a bottom view, or the curves of high-dimensional functions. Therefore, an efficient blade shape following the flow of air can be made, which has an effect of causing an increase in flow, an increase in static pressure, and a reduction in noise.

[Others]

Each pressure surface may have a tapered shape only at a portion of an area from the inner side to outer side of each blade. Also, in the lower end portion (partition-portion-side portion) of each blade, the pressure surface may become substantially perpendicular to a horizontal plane, similarly to the negative pressure surfaces, and only a portion of the pressure surface close to the upper shroud may have a tapered shape. Also, only in some blades of the plurality of blades, each pressure surface may have a tapered shape.

The pressure surface of each blade is not limited to the tapered shape as linearly shown in a cross section as shown in FIG. 7 described above. For example, each pressure surface may be formed so as to approach a corresponding negative pressure surface as it approaches the partition portion, while being slightly curved in a cross section as described above.

The shape of the pressure surface of each blade as seen in a bottom view may not be a shape in which three arcs are connected as described above, and may not be a shape expressed by a combination of high-dimensional functions passing three points. The blades need only to be formed in an appropriate shape satisfying a desired condition.

The negative pressure surfaces may not be substantially perpendicular to a horizontal plane as described above. For example, the negative pressure surfaces may be slightly inclined, like the pressure surfaces.

The shape of the casing is not limited to a substantially square shape as seen in a plan view. The casing may have any arbitrary shapes such as a polygonal shape, a circular shape, and an asymmetric shape. The fastening portions of the upper casing and the lower casing are not limited to the insides of four corners of the upper casing as seen in a plan view. For example, at portions connected to protrude outward from the outer peripheral edge forming a substantially square shape as seen in a plan view of the upper casing, screws, supports, and the like for assembling the upper casing and the lower casing may be provided.

Also, in a case where supports are provided between the upper casing and the lower casing at the portions for fastening the upper casing and the lower casing, the shapes of the supports may be, for example, as follow. That is, the supports may have a substantially cylindrical shape having a size allowing screws for joining the upper casing and the lower casing to pass through. If supports having a shape as described above are used, air expelled from the impeller is expelled outward from the sides of the casing, with little or no resistance. Therefore, noise of a centrifugal fan can be reduced.

The lower casing may be formed by using materials such as a resin material other than a metal plate. The upper casing and the lower casing may be formed integrally.

It should be noted that the above-mentioned illustrative embodiment is merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

What is claimed is:

1. A centrifugal fan comprising:

a casing including:

an upper casing having a circular opening through which a fluid is suctioned into the casing; and a lower casing made of metal;

an outlet opening provided between the upper casing and the lower casing;

an impeller disposed between the upper casing and the lower casing, the impeller including:

an upper shroud having an inlet opening formed at an upper part thereof;

a lower shroud that is disposed below the circular opening of the upper casing;

a plurality of blades arranged in a circumferential direction between the upper shroud and the lower shroud; and a motor mounted to the lower casing and attached to the lower shroud for rotating the impeller, wherein each of the blades has a pressure surface and a negative pressure surface in a rotation direction of the impeller, the pressure surface being inclined toward the negative pressure surface, wherein a distance between the pressure surface and the negative pressure surface is gradually decreased in a direction from the upper shroud to the lower casing, and wherein the pressure surface of each blade is inclined with respect to a rotation axis of the impeller to have an angle with respect to the rotation axis of the impeller being set to be within a predetermined range.

2. The centrifugal fan according to claim 1, wherein the negative pressure surface of each blade is substantially parallel to the rotation axis of the impeller.

3. The centrifugal fan according to claim 1, wherein each blade has a trapezoidal shape in a cross section on a plane which is perpendicular to a horizontal plane perpendicular to the rotation axis of the impeller and is perpendicular to the pressure surface thereof as seen in a bottom view.

4. The centrifugal fan according to claim 1, wherein the pressure surface of each blade has a shape in which at least three arcs are connected, or a shape expressed by a combination of a plurality of high-dimensional functions passing three points.

5. The centrifugal fan according to claim 1, wherein the pressure surface of each blade has the inclined shape entirely between an inner side edge and an outer side edge of the blade.

6. The centrifugal fan according to claim 1, wherein the angle of the pressure surface with respect to the rotation axis of the impeller is set to be in a range from 4 degrees to 16 degrees.

7. The centrifugal fan according to claim 6, wherein the angle of the pressure surface with respect to the rotation axis of the impeller is set to be in a range from 4 degrees to 8 degrees.

* * * * *